United States Patent [19]

Friskney

[11] Patent Number: 4,917,248

[45] Date of Patent: Apr. 17, 1990

[54] DISHWASHER RACK WITH MOVABLE FENCE

[75] Inventor: Stephen H. Friskney, Connersville, Ind.

[73] Assignee: White Consolidated Industries, Inc., Cleveland, Ohio

[21] Appl. No.: 296,437

[22] Filed: Jan. 12, 1989

[51] Int. Cl.[4] ..... A47G 19/08

[52] U.S. Cl. ..... 211/41; 211/184

[58] Field of Search ..... 211/41, 181, 182, 184, 211/74, 80, 85; 312/311; 108/61, 60; 403/391, 396, 400

[56] References Cited

U.S. PATENT DOCUMENTS

| | | | |
|---|---|---|---|
| 990,454 | 4/1911 | Peters . | |
| 2,516,088 | 7/1950 | Einhorn . | |
| 2,841,288 | 7/1958 | Field et al. . | |
| 3,269,548 | 8/1966 | Geiger et al. | 312/306 |
| 3,388,808 | 6/1968 | Radek . | |
| 3,752,322 | 8/1973 | Fiocca et al. . | |
| 4,046,261 | 9/1977 | Yake . | |
| 4,226,490 | 10/1980 | Jenkins et al. . | |
| 4,449,765 | 5/1984 | Lampman . | |
| 4,606,464 | 8/1986 | Jordan et al. . | |

FOREIGN PATENT DOCUMENTS

| | | |
|---|---|---|
| 2435670 | 2/1975 | Fed. Rep. of Germany . |
| 690743 | 8/1965 | Italy . |

*Primary Examiner*—Alvin C. Chin-Shue
*Assistant Examiner*—Sarah A. Lechok
*Attorney, Agent, or Firm*—Pearne, Gordon, McCoy & Granger

[57] ABSTRACT

A rack in a household dishwasher has a folding fence movable between a folded position adjacent the bottom of the rack and an erect or operating position. The fence has a base wire extending along the bottom of the rack and a plurality of projecting wires or pins extending upwardly therefrom. The fence is mounted on a plurality of brackets which snap over lateral wires on the rack at a bend therein so that the brackets are secured against rotation. The brackets provide a journal bearing to allow the base wire of the fence to both rotate and move axially, and the brackets also provide a dentent in the form of a U-shaped wall member which engages one of the projecting wires by axial movement of the fence to hold the fence in the upright position.

14 Claims, 4 Drawing Sheets

DISHWASHER RACK WITH MOVABLE FENCE

BACKGROUND OF THE INVENTION

This invention relates generally to dishwasher racks, and more particularly to a fence for a dishwasher rack which is selectively movable between a folded or inoperative position where it extends parallel to the bottom wall of the rack and an upright or operating position.

Dishwashers of the household type are generally manufactured to have a standardized set of exterior dimensions, particularly the height and width, to allow them to be installed in a standardized under-counter location. Because of the need for a certain amount of space at the bottom for the operating mechanism, the interior of the tub, therefore, has an almost standardized set of dimensions which result in the usual interior configuration of a sliding bottom rack located as near to the bottom of the tub as possible, together with a sliding upper rack positioned near the top wall of the tub in a location to allow it to accept as large an article as possible, subject to clearance with the top wall, as well as avoiding interference with larger items stacked in the lower rack.

The racks are generally formed from a steel wire coated with a plastic material, such as vinyl or nylon, which serves not only to protect the steel from rust but also prevents chipping and breakage of glass and china articles placed in the racks. The wires of the racks are generally configured in the form of a basket having side walls and a bottom wall which may be contoured to allow articles to assume a tilted position, particularly in the case of the upper rack, which is generally used for cups, saucers, and glasses, as compared to a lower rack normally used for larger plates and pots and pans, with silverware being placed in a separate receptacle generally attached to the lower rack. The racks are also provided with fences or members having upwardly projecting pins or wires with free ends to separate the stacked items, and this may create a problem if the load to be washed does not fit a predetermined arrangement of large and small articles. This is particularly true in the case of the upper rack, which is usually used for washing small articles. Thus, several fences may be mounted on the upper rack for separating and positioning small saucers, as well as holding glassware either against the side wall of the rack or by having some glasses fitted over one or more pins in an inverted position to prevent movement during washing, which could cause adjacent glasses or the like to contact each other and chip or break.

At times, the presence of a fence of upstanding wires, particularly on the upper rack, may not be suitable for the items to be loaded in the upper rack, and for this reason it has been proposed to make one or more fences on the upper rack, or even the lower rack, foldable so that they may be moved so that the wires are either in a stored or inactive position adjacent the bottom wall of the rack, or in an upright position for holding and spacing articles in the customary manner.

One of the earliest patents showing such an arrangement is U.S. Pat. No. 3,126,098, wherein the upper rack has a set of fence members formed of wire which are hinged to move between two positions, one of which conforms with the bottom of the rack and the other being limited by engaging a stop formed on the side wall of the rack. The hinge is formed by having one of the movable rack wires bent into a circle around a fixed wire on the bottom of the rack. With this arrangement, there is no positive means to hold the fence in the erect position, and the use of a direct contact hinge will result in rapid wear of the protective coating on the wire.

The next improvement over this is shown in U.S. Pat. No. 3,269,548, which is similar to the above structure except that the hinges are formed in separate hinge clips attached to the bottom rack and a flexible spring on the side wall has a notch to receive a fence wire on the end as a detent to hold it in the upright position.

A further improvement over the above arrangements is shown in U.S. Pat. No. 3,752,322, in which the fence has a flexible end wire extending against an arcuate retainer having a plurality of ridges and notches formed in it so that the fence may be held in a plurality of adjusted rotary positions while rotating about an axis determined by a hinge member on the bottom of the rack. In both of the latter two designs, the detent is formed by a resilient member and it is easily possible for the fence to be accidentally moved when pieces are being loaded on the upper rack.

Another arrangement is shown in U.S. Pat. No. 3,402,975, in which the dishwasher is of the top-loading type, and therefore has an upper rack that folds back to allow access to the lower rack. The upper rack includes a foldable fence having a horizontal wire and a plurality of vertical wires. The horizontal wire carries an index member fixed against rotation of the wire by having a portion grasping one of the vertically projecting wires. This index member engages a hub which pivots the wire, and interlocking detent means between the index member and the hub serve to hold the fence in place.

Still another arrangement is shown in U.S. Pat. No. 4,606,464, in which a rather complex mounting clip is used to provide a hinge and spring-loaded detents which engage laterally extending projections in the vertical wires of the fence.

Another arrangement which has been used to avoid the problem of providing rotating bearings and spring-loaded hinges is shown in U.S. Pat. No. 4,046,261, assigned to the assignee of the present invention. In this case, the rack is provided with a plurality of special support structures and individual fences may be inserted into grooves in these structures so that the fences may be either completely removed from the rack or inserted in the desired position.

SUMMARY OF THE INVENTION

The present invention provides an improved and simplified holding fence for use in a dishwasher rack, and is particularly adapted for mounting on an existing rack configuration so that it may be deleted in the case of lowerpriced models and added without modification on the other models when desired. The fence may either be left in a folded or a downward position, so that the rack may accommodate larger utensils, or raised and placed in a locked position by rotation and then lateral displacement along an axis, so that it may be positively locked in an upright position to accommodate smaller items such as glasses and saucers.

More particularly, the rack structure includes a plurality of bracket members which may be two or three in number and are clipped onto transverse wires of the rack bottom. The bracket members are arranged to be clipped onto an angled bend of the wires, so that by gripping on two angularly extending portions they are positioned securely and immovably in place. The fence member comprises an elongated wire which is journaled for both rotational and longitudinal movement in each of the brackets and includes a plurality of upwardly projecting wires in a conventional arrangement. When the fence is in the inoperative or folded position, the projecting wires rest on other members of the rack along the bottom surface so that they do not interfere with the stacking of larger utensils on top of them. Each of the brackets has an upwardly projecting detent arrangement comprising a pair of wall members of uneven length defining a U-shaped slot between them. The longer wall member serves as a stop to limit rotational movement of the fence to an upright position by engagement between the wall and a upwardly projecting wire when the fence is shifted its full axial extent in one direction, with the next adjacent wire engaging the opposite side of the bracket to limit axial movement in that one direction. When the fence is rotated to that position, it is moved axially so that the first upwardly projecting wire rides along the longer wall portion into the U-shaped slot portion, where it is positively restrained against rotation in the folded direction by the shorter wall portion.

With this arrangement, the fence member may be easily moved to and from folded and erect positions by a combination of rotational and axial movement, and when the fence is in the upright or operational position, the engagement of the pin in the U-shaped slot on the bracket provides a strong and positive retaining arrangement to prevent any further rotation of the fence in either direction.

DESCRIPTION OF THE PREFERRED EMBODIMENT

Figure 1:
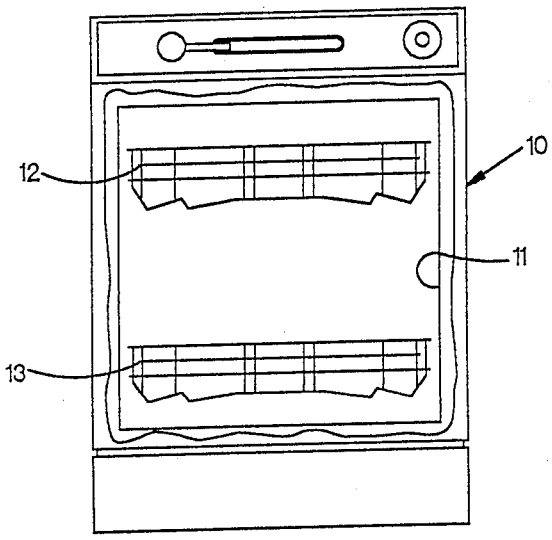
FIG. 1 is a front elevational view of a dishwasher showing the location of the upper and lower wash racks.
Figure 5:
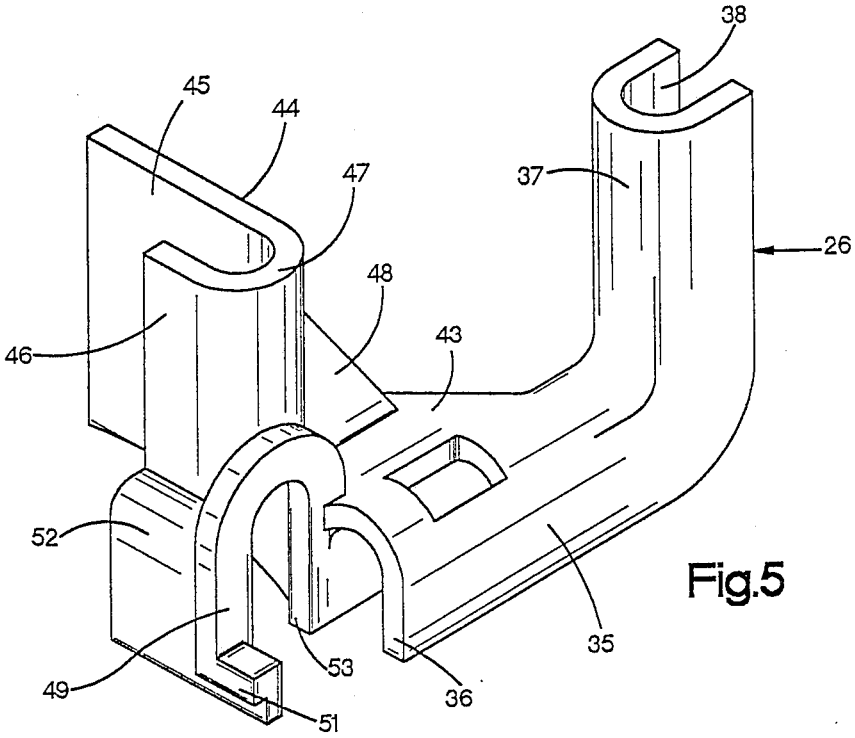
FIG. 5 is an enlarged, perspective view of the mounting bracket.
Figure 2:
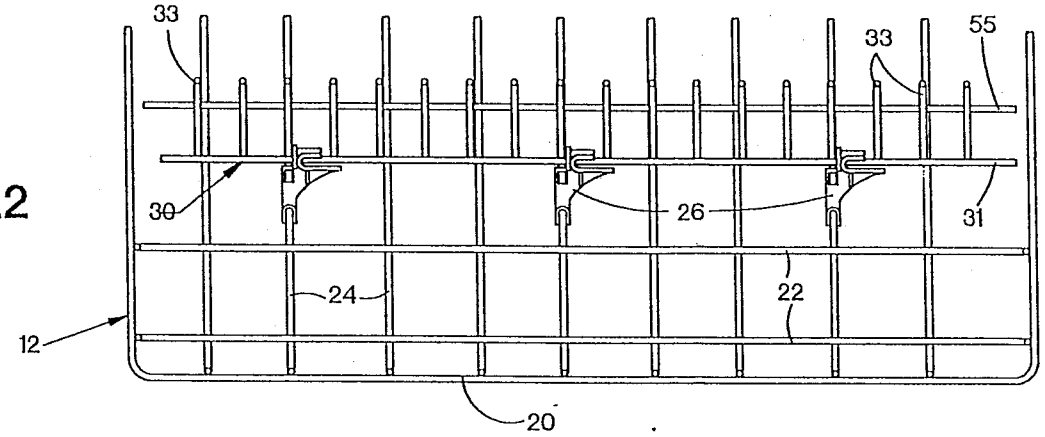
FIG. 2 is a fragmentary, plan view of the upper wash rack, showing the fence according to the preferred embodiment of this invention in the folded or inoperative position.
Figure 3:
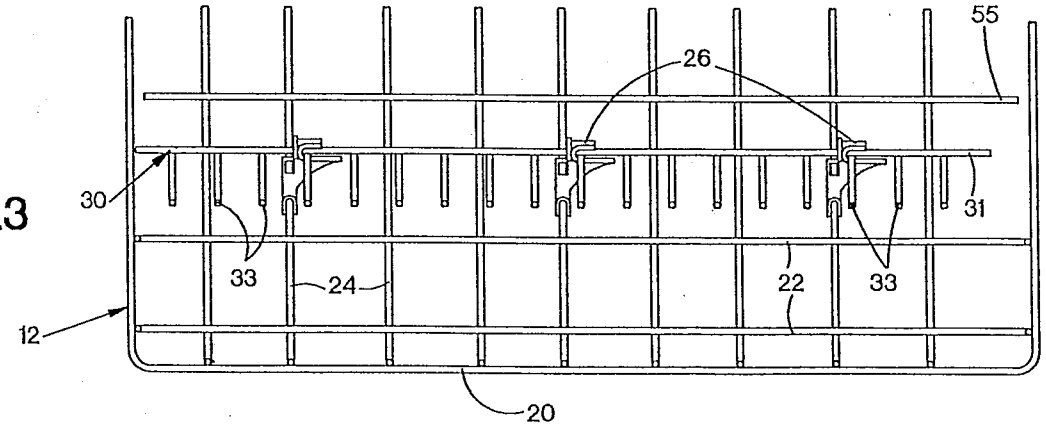
FIG. 3 is a fragmentary view similar to FIG. 2 but showing the fence in the erect or operating position.

As a matter of illustrative background, FIG. 1 shows a household dishwasher 10 with the downward opening door broken away to show the interior of tub 11 and the general arrangement of the upper and lower racks 12 and 13 mounted therein. It will be understood that the racks 12 and 13 are mounted in the conventional manner, in which the lower rack 13 rolls out onto the inner surface of the door when it is in the open position, while the upper rack 12 is mounted on suitable slides and rollers on the side walls of the tub 11 to reciprocate between a position within the tub 11 and a position in which it is substantially exposed for the loading and unloading of various utensils to be washed. The foregoing description is by way of background illustration only, since the present invention is directed to a fence construction that may be used on either one of the racks 12 and 13, and is preferably used on the upper rack 12, as shown in greater detail in FIGS. 2–4.

The racks are generally formed from round steel wire which is bent to shape and the various pieces of wire assembled together and welded at each intersection to form a relatively rigid basket. After the welding has been completed, the basket is given a complete coating of a suitable soft plastic material, such as polyvinyl chloride. This coating is made to be quite thick, since it not only preserves and protects the steel wire from rust and corrosion and gives a surface that will remain clean and free from adhering material during use, but also serves as a cushioning means to prevent fragile items such as glasses and small plates from cracking and chipping by reason of any contact with the rack. Thus, the upper rack, as shown in greater detail in FIGS. 2–4, comprises peripherally extending upper and lower frame wires 20 and 21 which extend around the outer four sides of the rack, which may also include intermediate side wires 23, as required for stiffness, and to limit opening size for retention of relatively small items placed on the rack. To form the bottom and side walls in addition to the frame wires, the rack includes base wires 22 extending from front to back over the rack bottom, together with tie wires 24 extending crosswise at right angles to the base wires. Some of the base wires 22 and tie wires 24 have bent portions extending upwardly along the sides where they are welded to the frame wires to complete the structure of the rack.

The folding fence of this invention is assembled onto the rack after the rack has been completely manufactured, including all welding and other assembly operations, as well as the application of the coating. Thus, the folding fence of this invention is, in effect, an optional choice to be added to a rack after completion of assembly, since the presence or absence of the fence does not otherwise affect the construction and operation of the rack. However, if the folding fence were omitted, presumably a fixed fence including a fixed base wire and upstanding pins would be used in its place.

The fence is mounted on a plurality of at least two, but preferably three, brackets 26, which serve not only to mount and journal the fence but also provide the detents for holding it in the upright or operating position. The brackets 26 are arranged to, in effect, snap over an adjacent tie wire 24 and are particularly arranged to be located at the junction of a cross portion 27 and bent portion 28. By attaching the bracket to the two angularly extending portions of the tie wire, the bracket becomes fixedly mounted and will not rotate or slide axially along the tie wire. The brackets 26 serve to mount the fence 30, which includes a longitudinally extending base wire 31 which is journaled for rotational and axial movement in each of the brackets 26 and carries integral, upwardly projecting pins or wires 33 extending in spaced, parallel array substantially perpendicular to the axis of the base wire 31. It will be understood that the fence 30 is also formed from wire similar to that used for the rack itself and which previously had been given the same protective coating, and that the brackets 26 are preferably formed by molding from a suitable plastic material such as acetal copolymer.

Figure 4:
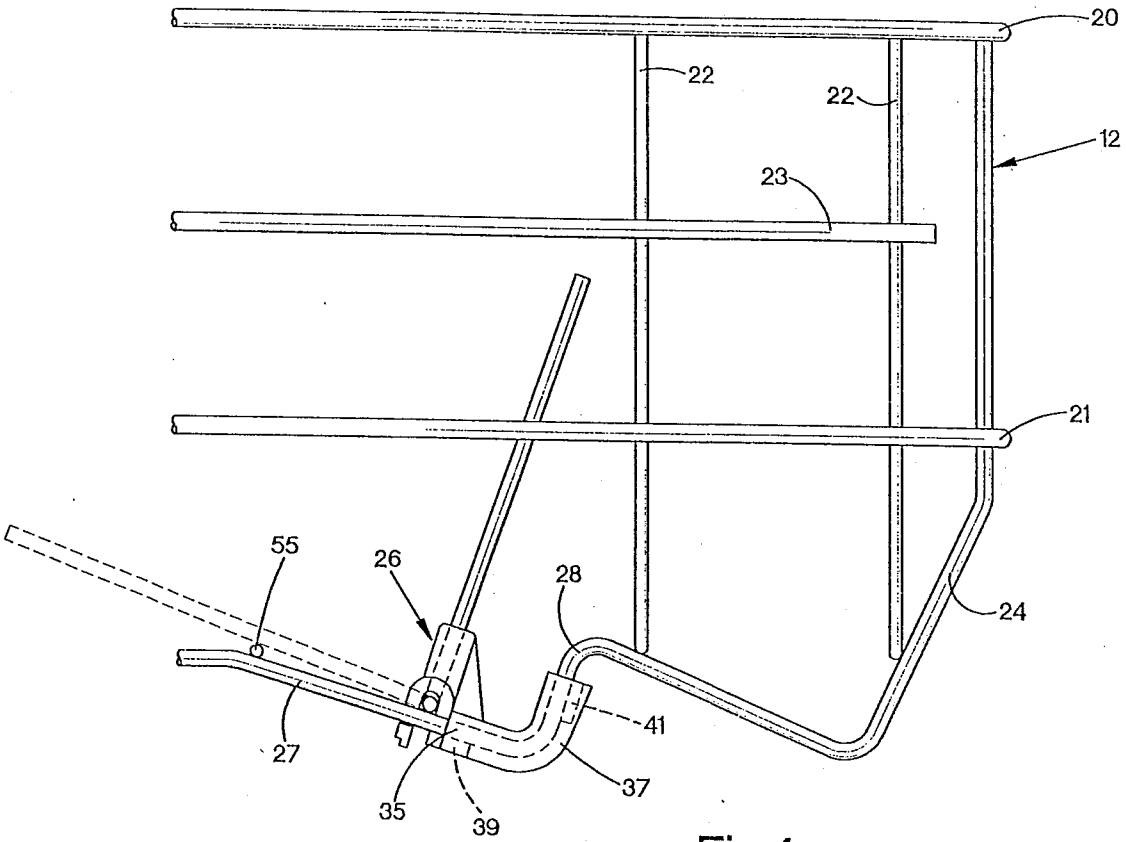
FIG. 4 is an enlarged, fragmentary, elevational view of the upper rack showing the mounting of the fence.
Figure 10:
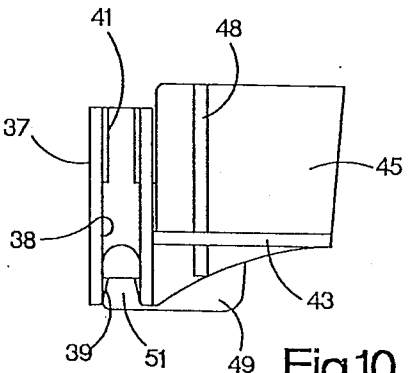
FIG. 10 is a side elevational view of the mounting bracket from the side opposite that shown in FIG. 7.
Figure 8:
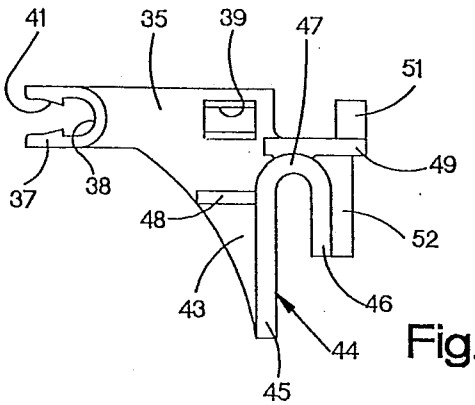
FIG. 8 is a top plan view of the mounting bracket.
Figure 9:
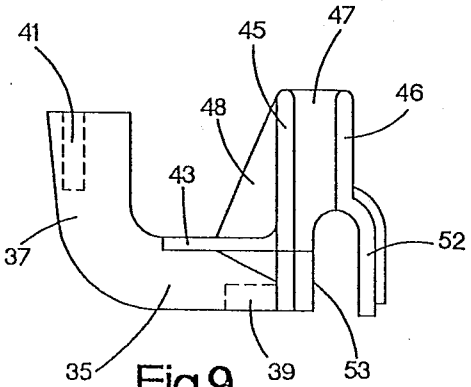
FIG. 9 is an end elevational view of the mounting bracket looking toward the left in FIGS. 2 and 3.
Figure 6:
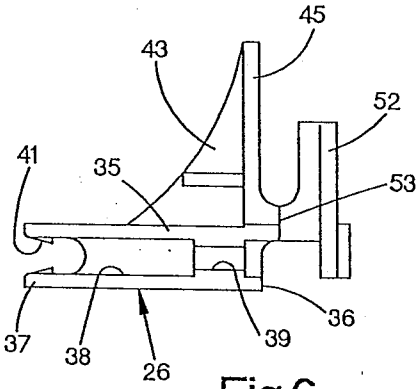
FIG. 6 is a bottom view of the mounting bracket of FIG. 5.
Figure 7:
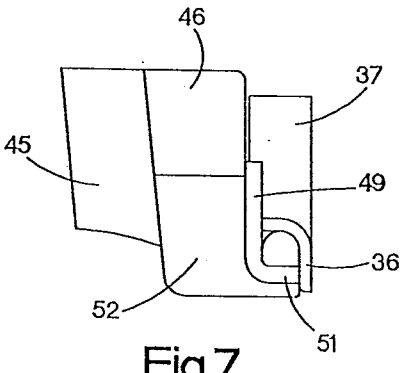
FIG. 7 is a side elevational view of the mounting bracket.

The structure of the brackets 26, the arrangement for mounting them on the tie wires 24, and the mounting of the fence are shown in greater detail in FIGS. 4–10, it being understood that each of the brackets 26 is identical, and therefore it is necessary to describe the construction and mode of operation of only a single bracket. The bracket includes a base portion 35 having an end face 36 on one side and an extension portion 37 extending substantially at right angles to the base portion 35. The base portion 35 and extension 37 are basically in the shape of an inverted U to define a channel 38 which extends over the tie wire cross portion 27 and bent portion 28, as best shown in FIG. 4. In the base portion 35, the channel 38 has a pair of opposed projecting detents 39 which snap over the wire to hold the bracket in place on the cross portion 27. Likewise, in the channel in the extension portion 37 are a similar pair of detents 41 which snap over the bent portion 28 and also serve to hold the bracket in place. Because the tie wire portions 27 and 28 form substantially a right angle, the attachment of the channel over these portions of the wire ensures that the bracket is positively held in place and cannot move either axially or along or rotatably around the tie wire 24 so that the bracket is firmly fixed in place on the rack.

The bracket 26 includes a platform portion 43 extending laterally from base portion 35 generally parallel with the bottom wires of the rack. Projecting upwardly from the platform 43 is a detent portion 44 including a long wall 45 and a short wall 46 joined by a U-shaped bend 47. The walls 45 and 46 extend parallel to each other and project perpendicular to the tie wire cross portions 27, which, since they are inclined slightly from the horizontal, ensures that the walls 45 and 46 will be tilted a similar angle off the vertical. To provide the necessary rigidity, a fillet 48 may extend between the long wall 45 and platform 43, and the bracket may include other fillets and stiffening ribs, as required to ensure rigidity.

The bracket 26 also includes a hook portion 49 extending from base portion 35 beyond the end face 36 to hook downward alongside the cross portion 27 and at its lower end, the hook portion 49 has a projecting tab 51 extending beneath the cross portion 27 to more positively hold the bracket in place on the tie wire 24. The bracket also includes a wall portion 52 extending laterally from the hook portion 49 and upwardly to join the short wall 46. The wall portion 52, together with a projecting boss 53 on the base portion 35 extending beyond the face 36, provide a guide and bearing for the fence base wire 31, as described hereinafter.

The fence and brackets are easily mounted on the rack by placing the fence at the intended location, with the base wire 31 in contact with the cross portion 27. Each of the brackets is then slipped over the fence and pressed onto the tie wire 24 by snapping the base portion 35 and extension portion 37 over the cross portion 27 and bent portion 28 of the tie wire until the detents 39 and 41 snap into place. Since the bracket is made of a flexible plastic material, it can deflect to allow the detents 39 and 41 to snap over the wire at the same time the hook portion 49 and tab 51 are deflected laterally to hook underneath the cross portion 27. With the fence 30 in position, the base wire 31 is supported on the cross portion 27 and held in place by the hook portion 49 extending over the top of the base wire 31 and lateral movement is restrained by the remaining portion of the hook portion 49 and the boss 53. However, the fence is free to move axially along the axis of base wire 31 a distance determined by the spacing of the pins 33. When the fence is in the folded position, as shown in dotted lines in FIG. 4 and in FIG. 2, the pins rest on an adjacent base wire 55, and because of this support, the pins 33 can be used to support various dishes of large sizes if so desired. In this position, the fence 30 can move a short distance axially as determined not only by the spacing between the pins 33, but also the spacing determined by the distance between the hook portion 49, against which one wire abuts as a stop if the fence is slid toward the rear and the other edge determined by wall portion 52 and short wall 46 against which the next adjacent pin abuts if the fence is moved toward the front of the machine.

To raise the fence to the erect or operating position, it is merely necessary to take hold of some of the pins 33 and rotate the fence to an upright position as shown in FIG. 4. It should be noted in this position that the spacing between the pins 33 is such that the one pin will remain in abutment against the side of hook portion 49 when the next adjacent pin contacts the long wall 45 of detent 44 to prevent further rotation in that direction. Because of the length of wall 45, it is not possible to rotate the fence further beyond the erect position, so that the total rotation is limited to about 90 degrees. To hold the fence in the erect position, it is then merely necessary to slide the fence forwardly so that the pin adjacent wall 45 moves into contact with the bend 47, at which point the two walls 45 and 46 will positively resist rotation of the fence in either direction. To fold the fence, it is therefore merely necessary to slide the fence backward toward the rear of the dishwasher until the one pin clears the short wall 46 and it is possible to rotate the fence down into the folded position. With this arrangement, it is not necessary to provide any tensioning or detent springs and the positive location of the pins 33 between the two walls 45 and 46 ensures a positive and strong detent or locator for the fence in the upright position.

Although the preferred embodiment of the invention has been shown and described in detail, it is recognized that other modifications and rearrangements may be resorted to without departing from the scope of the invention as defined in the claims.

What is claimed is:

1. A dishwasher rack assembly comprising wire members secured together to form a generally horizontal bottom wall, a fence pivotally mounted on said bottom wall for movement between a folded horizontal position and an erect vertical position, said fence having a base wire member defining an axis and a plurality of projecting wires secured to said base wire member and extending at an angle to said axis, means journaling said base wire member for both rotational and longitudinal movement with respect to said axis, and detent means secured to said rack engageable with one of said projecting wires for holding said fence in said erect position, said one projecting wire being engageable and disengageable with said detent means by longitudinal movement of said fence along said axis.

2. A dishwasher rack assembly as set forth in claim 1, wherein said detent means includes first and second wall portions engaging opposite sides of said one wire.

3. A dishwasher rack assembly as set forth in claim 2, wherein said wall portions extend from said base wire a distance upward along said one wire.

4. A dishwasher rack assembly as set forth in claim 2, wherein said detent means includes a bend joining said first and second wall portions, said bend limiting axial movement of said fence in the engaging direction.

5. A dishwasher rack assembly as set forth in claim 1, wherein said journaling means and said detent means are on a unitary member.

6. In a dishwasher rack assembly having longitudinal and lateral wire members secured together to form a generally horizontal bottom wall and a hinged fence pivotally mounted on said bottom wall for movement between a folded horizontal position and an erect vertical position, the improvement comprising at least two brackets secured to said bottom wall, said fence having a base wire member defining an axis and a plurality of projecting wires secured to said base wire member and extending at an angle to said axis, means journaling said base wire member in each of said brackets for both rotational and longitudinal movement with respect to said axis, and detent means on at least one of said brackets for holding said fence in said erect position, said fence being engageable and disengageable with said detent means by longitudinal movement of said fence along said axis.

7. A dishwasher rack assembly as set forth in claim 6, wherein each of said brackets is mounted on one of said lateral wire members.

8. A dishwasher rack assembly as set forth in claim 7, wherein each of said brackets is formed with a channel and detents to make a snug fit on the lateral wire member.

9. A dishwasher rack assembly as set forth in claim 8, wherein said lateral wire member and said channel have portions extending at an angle to each other to prevent rotation of said bracket about said lateral wire member.

10. A dishwasher rack assembly as set forth in claim 6, wherein said detent means is engaged by at least one of said projecting wires.

11. A dishwasher rack assembly as set forth in claim 10, wherein said detent means includes first and second wall portions extending along and engaging opposite sides of said one projecting wire.

12. A dishwasher rack assembly as set forth in claim 11, wherein said detent means includes a bend portion joining said first and second wall portions, said bend portion being engageable by said one projecting wire to limit axial movement of said fence in the engaging direction.

13. A dishwasher rack assembly as set forth in claim 12, wherein at least one of said brackets has a stop portion engageable by an adjacent projecting wire to limit axial movement of said fence in the disengaging direction.

14. A dishwasher rack assembly as set forth in claim 13, wherein said first wall portion has a sufficient length along said axis to be engageable with said one wire when said adjacent wire engages said stop portion to limit rotation of said fence beyond said erect position.

* * * * *